United States Patent [19]

Brucker et al.

[11] Patent Number: 4,612,550

[45] Date of Patent: Sep. 16, 1986

[54] INVERTED CASSEGRAIN ANTENNA FOR MULTIPLE FUNCTION RADARS

[75] Inventors: Jean-Michel Brucker; Bernard Estang, both of Paris, France

[73] Assignee: Thomson CSF, Paris, France

[21] Appl. No.: 480,805

[22] Filed: Mar. 31, 1983

[30] Foreign Application Priority Data

Apr. 2, 1982 [FR] France ..... 82 05787

[51] Int. Cl.[4] ..... H01Q 19/195

[52] U.S. Cl. ..... 343/756; 343/781 CA; 343/915

[58] Field of Search ..... 343/781 CA, 756, 909, 343/912, 914–916, 781 P, 761, 837, 839, 779

[56] References Cited

U.S. PATENT DOCUMENTS

| | | | |
|---|---|---|---|
| 3,161,879 | 12/1964 | Hannan et al. | 343/756 |
| 3,576,566 | 4/1971 | Cover et al. | 343/915 |
| 3,717,879 | 2/1973 | Ganssle | 343/915 |
| 4,253,100 | 2/1981 | Commault et al. | 343/781 CA |

*Primary Examiner*—Eli Lieberman
*Assistant Examiner*—Michael C. Wimer
*Attorney, Agent, or Firm*—Cushman, Darby & Cushman

[57] ABSTRACT

An inverted Cassegrain antenna utilizing polarization rotation. The polarizer-reflector or mirror utilized comprises two or more polarizer-reflector elements joined together around hinges perpendicular to the widening direction required. A sheet comprising parallel metal wires covers the whole of the elements. For each element, a metal film is separated from the sheet by a first dielectric layer. Each hinge is formed, on one side, by the flexible sheet of metal wires which straddles the gap between elements. The other side of the hinge includes a second dielectric layer backed by a rigid metal strip, also straddling the gap. One end of the metal strip is fixed to the metal film of one adjacent element while the other end of the metal strip is in moveable electrical contact with the metal strip of the other adjacent element. The antenna is particularly applicable to multiple function radars.

20 Claims, 11 Drawing Figures

PRIOR ART

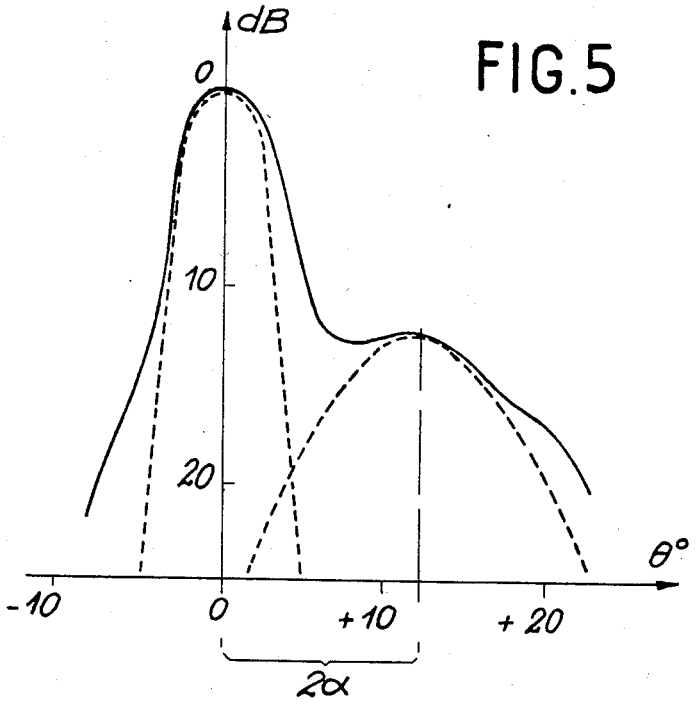
FIG.5
FIG.6
PRIOR ART
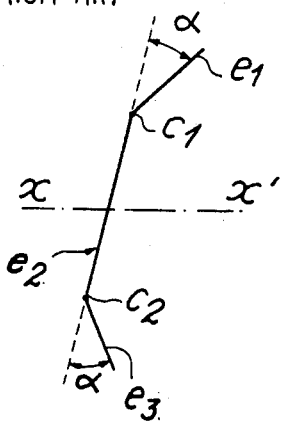
FIG.7
PRIOR ART
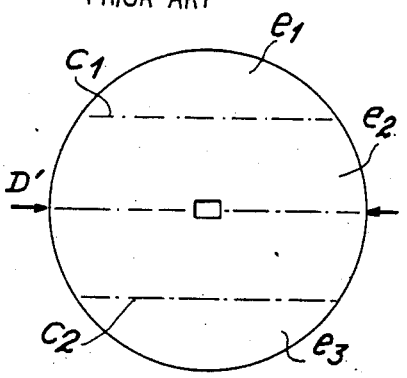

PRIOR ART

INVERTED CASSEGRAIN ANTENNA FOR MULTIPLE FUNCTION RADARS

BACKGROUND OF THE INVENTION

The present invention relates to an inverted Cassegrain antenna intended for use in the monitoring or tracking modes and which is able to provide a beam which is widened either in the elevation plane (sighting) or in the bearing plane (anticollision) whilst retaining the qualities of a narrow primary beam.

The inverted Cassegrain antenna is known and is described, for example, in U.S. Pat. No. 3,771,160 which relates to an inverted Cassegrain antenna utilizing polarization rotation. The antenna disclosed in this patent comprises a plane auxiliary reflector formed by a plurality of grids of parallel conductive wires and by a metal plate, the plate and the grids of wires being parallel and separated by a dielectric. Such an antenna operates on at least two frequencies, but cannot be utilised in combination with a multiple function monitoring or tracking radar.

In a multifunction radar, it is in fact desirable that the beam transmitted by the antenna have a shape which may be adapted at a given instant to the function for which it is utilised. This has already been produced with simple antennas, by switching of primary sources or by altering the shape of the antenna. However, this means of adapting an antenna for the different functions of a radar does not yield satisfactory results in the case of an inverted Cassegrain antenna. As a matter of fact, the performance factors of the Cassegrain antenna are reduced if the primary sources of this antenna are multiplied or if the parabolic reflector is distorted, which imposes the need to modify the beam focussing device.

An advantageous means of producing a multifunction inverted Cassegrain antenna is to modify the form of the polarizing rotation reflector with which it is equipped, in order to widen the beam in a given direction.

French Pat. No. 2,448,233, (corresponding to U.S. Pat. No. 4,253,100) filed on the 2nd of February 1979, discloses a multifunction inverted Cassegrain antenna comprising a polarizing rotation reflector formed by two or more polarizer-reflector elements articulated in pairs around a hinge orthogonal to the required beam widening direction.

The articulation between the two polarizing reflector elements may be produced in the form of a simple hinge bonded to the rear section of the polarizing rotation reflector. However, this kind of joint produces radioelectric discontinuities in the region of the front surface of the polarizer, as well as in the region of the reflector at the rear side, and a radioelectric mismatching effect in the region of the joint. These discontinuities impair the characteristics of the antenna when the reflector elements are rendered coplanar.

These radioelectric deteriorations which are caused by the noted electric discontinuity are accentuated by the mechanical defects of a hinge of this nature. In effect, a distance of a few millimeters remains between the two sections of the reflector in the coplanar position. Furthermore, the hinge does not cover the whole width of the reflector at the point of the interruption. Consequently, the positioning of the movable element is not of constant accuracy across the whole width of the interruption.

These electrical and mechanical defficiencies cause a rise of the distant secondary lobes for particular sweeps of the antenna.

The present invention makes it possible to remedy the disadvantages referred to above and to maintain a mechanical and radioelectrical continuity in the region of the hinge joining together two elements of the polarizing reflector throughout the antenna sweep and no matter what the angle of inclination of the movable element may be.

The present invention equally has as an object to re-establish the angular phase shift of 180° in the region of the gap present between two elements and to retain the planeity of the polarizer-reflector.

SUMMARY OF THE INVENTION

In accordance with the invention, an inverted Cassegrain antenna for multifunction radar applications includes a polarization rotating mirror composed of a plurality of reflector-polarizer elements each of which includes a reflective layer on one side of a plane of dielectric material, and a sheet of parallel metal wires which are inclined at 45° with respect to the direction of polarization of the incident radiation, mounted on the other side of the dielectric material. The reflector-polarizer elements are articulated by pairs around a hinge structure which is formed on one side by the sheet of metal wires which, in a continuous and flexible manner, covers the whole of the plane polarizing reflector elements and adheres to the intermediate dielectric layer. The hinge is formed on the other side by a metal strip which is parallel to the surface of the said sheet and which is secured to the reflective layer of a first polarizer-reflector element by fastening means and is also in moveable electrical contact, by conductor means, with the back of the reflective layer of a second polarizer-reflector element movable with respect to the first element.

BRIEF DESCRIPTION OF THE DRAWINGS

The invention will now be further described, by way of examples, with reference to the accompanying drawings, in which:

FIG. 5 illustrates the characteristics of a wide beam obtained with an antenna according to the invention;

FIGS. 6 and 7 illustrate, respectively, the side and front views of a particular embodiment of a polarization rotation reflector utilized for a multifunction radar;

DESCRIPTION OF THE PREFERRED EMBODIMENTS

Figure 1:
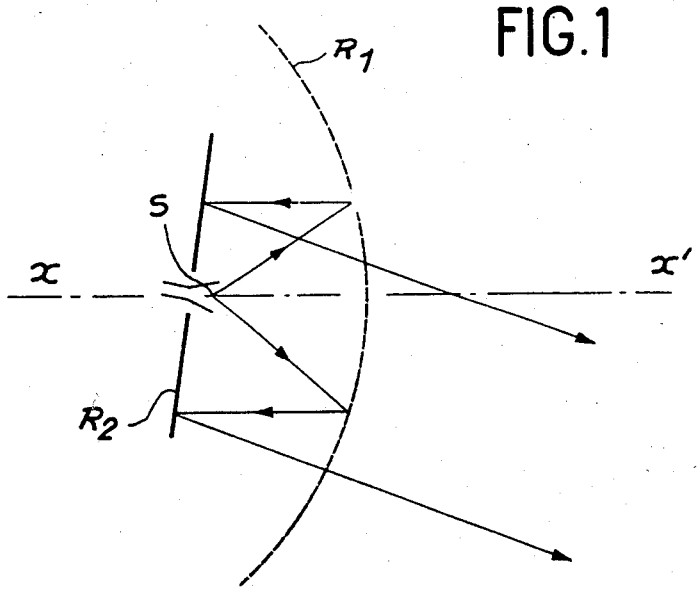
PRIOR ART FIG.1
FIG. 1 illustrates an inverted Cassegrain antenna having a plane polarizing reflector of a conventional type.

As is apparent from FIG. 1, an inverted Cassegrain antenna of a known type comprises a primary source S intended to transmit high-frequency electromagnetic waves, a primary parabolic reflector $R_1$ having an axis of revolution xx' reflecting the radiation of the primary source S and selectively transmitting the radiation having a rectilinear cross-polarization, and an auxiliary reflector (or mirror) $R_2$ using a polarization rotator and having a plane form, the whole forming a focussing system. During transmission, the primary source S has the function of illuminating the focussing system with an electromagnetic wave having a rectilinear polarization (for example horizontal polarization), radiating a well defined amplitude revolution, phase and polarization diagram; and during reception collecting in optimum conditions, the energy provided by the echo and concentrated by the focussing system in the neighborhood of its focus F, in the form of a diffraction pattern.

During operation, the primary source S (FIG. 1) situated at the focus F of the parabolic reflector $R_1$ emits a radiation having a linear (horizontal) polarization which is wholly reflected by the parabolic reflector $R_1$, the angle subtended by the incident beam and the reflected beam being equal to the angle between the incident beam and the axis xx' of the reflector $R_1$. The reflected rays, parallel to the axis xx', are received by the auxiliary reflector (or mirror) $R_2$ and reflected, after a rotation of $\pi/2$ of their plane of polarization (the horizontal polarization of the incident wave is converted into vertical polarization), towards the parabolic reflector $R_1$ allowing the radiation with a vertical polarization plane to pass, the beam emitted from the antenna then being a parallel beam.

According to the French Pat. No. 2,448,233 (corresponding to U.S. Pat. No. 4,253,100), an inverted Cassegrain antenna comprises a primary source S, a primary parabolic reflector R reflecting the primary radiation emerging from the source S and able to transmit selectively the radiation having a rectilinear cross polarization, this source S being situated substantially at the focus F of the primary reflector R, a polarization rotation reflector formed by at least two plane-shaped polarizer-reflector elements, joined together in pairs by a hinge providing their mutual articulation. The hinges are positioned in a direction perpendicular to the required beam widening plane.

The form of the parabolic reflector R is known per se. This reflector R may for example be formed by a sheet of horizontal wires if the rectilinear polarization of the incident wave coming from the primary source S is horizontal.

The polarizer-reflector elements forming the polarization rotation reflector may have relatively variable inclinations. The displacements of the elements around their hinge respective hinges and their locking at a particular setting are obtained, in the case of an antenna according to the invention, by means of a control device intended to be actuated during the operation of the radar.

Figure 2:
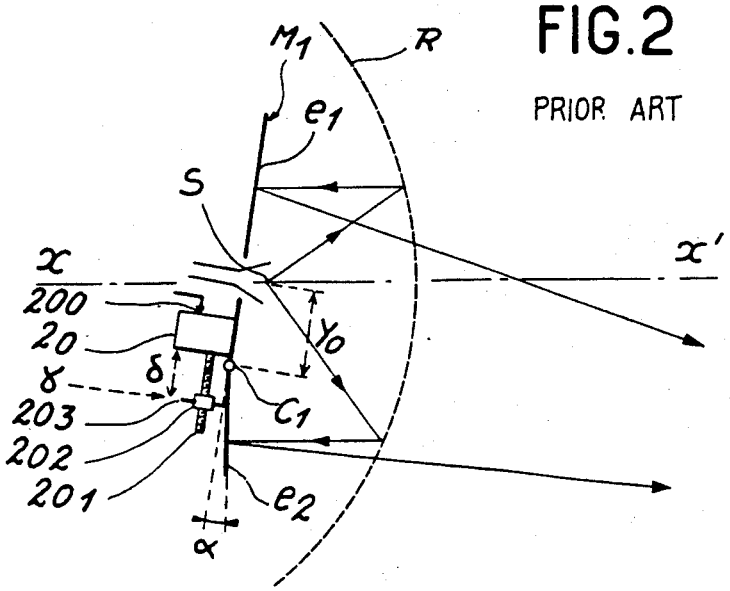
FIG.2 PRIOR ART
FIG. 2 illustrates an embodiment of an inverted Cassegrain antenna for a multifunction radar.

The remote control device 20 is illustrated only by way of non-limiting example in FIG. 2, in order to avoid overcrowding of the drawings and in order to permit a better understanding of the latter.

In the non-limiting example of FIG. 2, the polarization rotation reflector denoted by the symbol $M_1$ comprises two polarizing reflector elements $e_1$, $e_2$ subtending an angle between them and joined together by the hinge $C_1$ perpendicular to the beam widening plane which, in this instance, is the symmetry plane of the antenna coinciding with the plane of the figure. The control device 20 is formed, for example, by a motor integral with the reflector $M_1$, of which the axis 201 is formed by an endless screw 201 equipped with a cursor 202 driven by the endless screw 201 in translational displacement $\delta$ along the direction of the reflector $M_1$ in the plane of FIG. 2. The displaceable cursor 202 is equipped with a pointer 203 movable in a direction $\gamma$ perpendicular to the direction of translational displacement $\delta$ of the cursor and driven in this direction by a system of gears. The movable pointer 203 has one of its extremities engaged in a slideway situated at the back of the reflective surface of the polarizing reflector element $e_2$. To simplify matters, the slideway has not been illustrated in FIG. 2. The motor 20 is actuated by means of control signals via a control input 200. Each angular position of the motor shaft thus has corresponding to it, a value $\Delta\delta$ which represents an angle $\alpha$. Any other equivalent control means for the reflector element $e_2$ remains within the scope of the present invention.

In the remainder of the description, the diameters of the polarization rotation reflector (if its component elements are coplanar) which are perpendicular and parallel to the hinges respectively, are denoted by D and D'.

Consequently, this reflector $M_1$ permits reflecting on the parabolic reflector R of rays having different angles of reflection depending on the element $e_1$ or $e_2$ on which they impinge. It may thus be considered that there are two radiating pupils having slightly different complex amplitude distributions which cooperate to form the beam required, in space.

A simple calculation makes it possible to determine the phase law in the case of the reflector $M_1$ comprising two elements $e_1$, $e_2$.

In effect, the joint $C_1$ sets up a linear phase law proportional to the angle $\alpha$ subtended between the elements $e_1$ and $e_2$. If $/y_o/$ is the distance from the hinge $c_1$ to the axis xx' of the antenna $(-D_o/2<y_o<D_o/2)$. $D_o$ being the diameter of the reflector, the phase law may be set down for a point of the reflector situated at the distance $/y/$ from the axis xx' $(-D_o/2<y<D_o/2)$:

$$\text{for: } \frac{D_o}{2} > y > y_o \text{ (element } e_1) \ \phi = 0 \text{ by convention}$$

and for:

$$+ y_o > y > -\frac{D_o}{2} \text{ (element } e_2) \ \phi = (y - y_o)\frac{2\pi}{\lambda} \sin 2\gamma.$$

Figure 3:
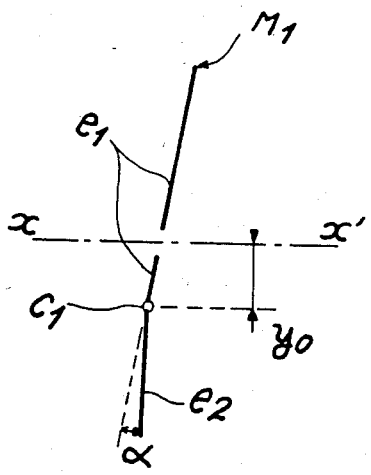
FIG. 3 PRIOR ART
FIGS. 3 and 4 illustrate, respectively, an end view and a front view of one reflector utilized in FIG. 2.
Figure 4:
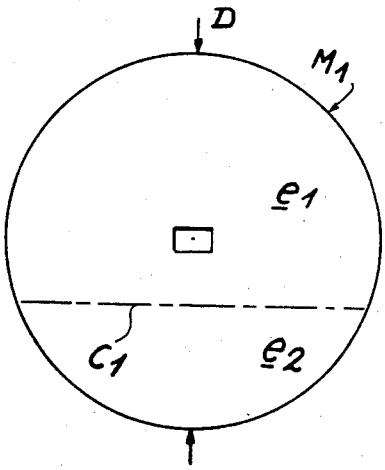

According to a non-limiting embodiment illustrated by FIGS. 3 and 4, the hinge $C_1$ articulating the two elements $e_1$ and $e_2$ forming the polarizing reflector of FIG. 1, is situated at a third of the diameter D and is perpendicular to the vertical symmetry plane of the antenna, illustrated by the plane of FIG. 3 and containing the diameter D. This element $e_2$ which is the smaller element, slopes at an angle $\alpha$ of for example 7° with respect to the element $e_1$. A reflector $M_1$ of this kind permits an elevation coverage having a decrease in gain which substantially follows a cosecant squared law, such that the level at −17 dB is reached at 20° from the axis instead of the 5° obtained with a conventional narrow beam (FIG. 5). The beam characteristics are moreover of little selectivity as regards frequency i.e. the bandwidth is wide.

According to another non-restrictive embodiment, illustrated by FIGS. 6 and 7, the polarizer reflector $M_2$ comprises three polarizer-reflector elements $e_1$, $e_2$, $e_3$ articulated together by two hinges $C_1$, $C_2$ symmetrical with respect to an antenna diameter perpendicular to the diameter D. In the same way as before, a reflector of this kind makes it possible to secure an antenna operation with a narrow beam and "monopulse" channels, that is to say channels making it possible to obtain a separation signal from a target echo with respect to the axis xx' of the antenna, or with a wide beam and a "monopulse" channel when the polarizer-reflector elements $e_1$, $e_2$, $e_3$ are respectively coplanar or inclined symmetrically at a dihedral angle $\alpha$ with respect to the plane of the element $e_2$, and an operation with a widened asymmetrical beam, as illustrated in FIG. 5 when the polarizer-reflector elements slope asymmetrically.

FIG. 5 shows, along the vertical symmetry plane of the antenna, a radiation diagram as a function of a direction $\theta$ with respect to the axis xx'. A relative radiation maximum is obtained in the direction $2\alpha$.

It is convenient to observe that in the case of "monopulse" channels in an antenna according to the invention, the asymmetric widened beam being obtained on the sum channel, the difference channel formed along the vertical symmetry plane of the antenna perpendicular to the hinges equally become asymmetrical and unusable because of this. By contrast, a difference channel can be established along the plane parallel to the hinges, the symmetry along this plane being retained. However, in the other plane the benefit is enjoyed of a widening analogous to that of the sum channel.

It should be noted moreover that the characteristics of the beam emitted by the antenna of FIG. 2 are of little selectivity as regards frequency.

Finally, it should be noted that the embodiments of the antenna described and illustrated are not restrictive, in particular as regards the number of polarizer-reflector elements forming the polarization rotation reflector.

Figure 8:
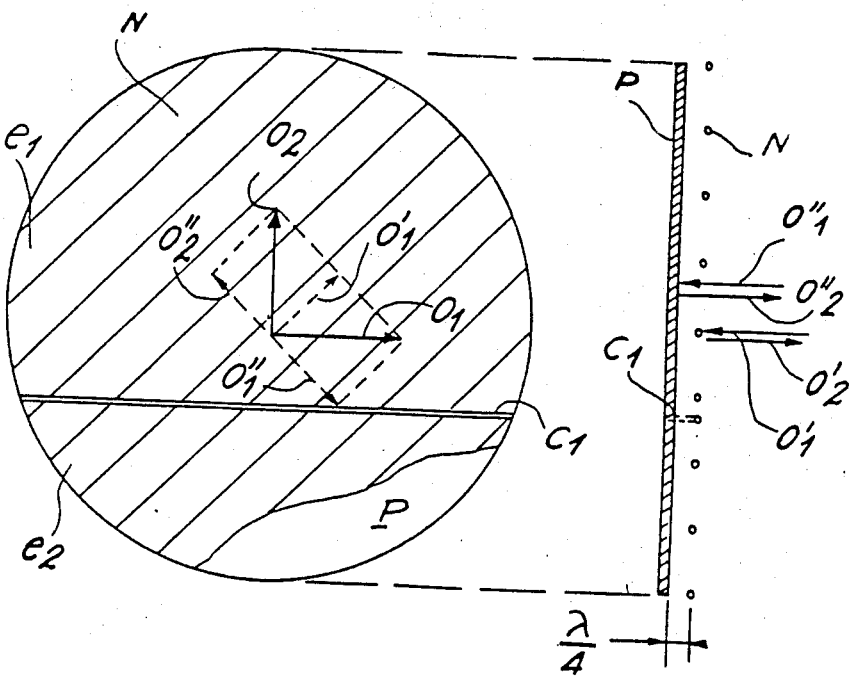
FIG. 8 illustrates a detail of the embodiment of the polarizing rotation reflector utilized in FIG. 2.

In a manner known per se as illustrated by FIG. 8, the polarizer-reflector elements ($e_1$, $e_2$ of FIGS. 2 to 4, for example), may be formed by a metal plate P and by a sheet N of parallel wires sloping at 45° with respect to the direction of incident rectilinear polarization, this sheet N being situated at $k\lambda/4$ from the plate P, k being an odd integer and $\lambda$ the operating wavelength of the antenna. During operation, an incident wave $O_1$ having a horizontal rectilinear polarization, may be considered as the superimposition of two equiphasal component waves $O'_1$ and $O''_1$, of which the planes of polarization are inclined at 45° with respect to the plane of polarization of the incident wave $O_1$, the first component $O'_1$ being parallel to the wires of the sheet N and the second component $O''_1$ being perpendicular to these wires. The first component $O'_1$ is consequently reflected by the wires whereas the second component $O''_1$ passes through the sheet N after having covered a distance equal to $2k\lambda/4$, say a distance equal to $k\lambda/2$. At this instant, the second component $O''_2$ reflected is consequently shifted in phase by $\pi$ as compared to the first component $O'_2$ reflected, and the combination of the two components then generates a wave $O_2$ having a vertical polarization able to pass through the parabolic reflector allowing vertically polarized radiation to pass and reflecting horizontally polarized radiations. Use may also be made of parallel metal strips, equally inclined at 45° with respect to the direction of incident polarization of the radiation, in order to produce these polarizer-reflector elements without exceeding the scope of the present invention.

Figure 9C:
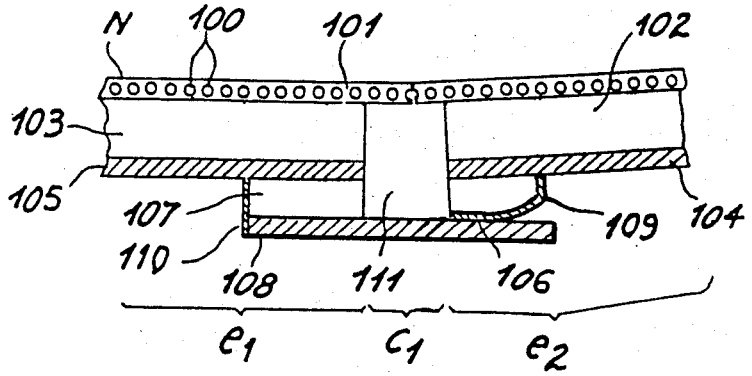
FIGS. 9A, 9B and 9C illustrate the cross-section of the polarization rotation reflector according to the invention.
Figure 9A:
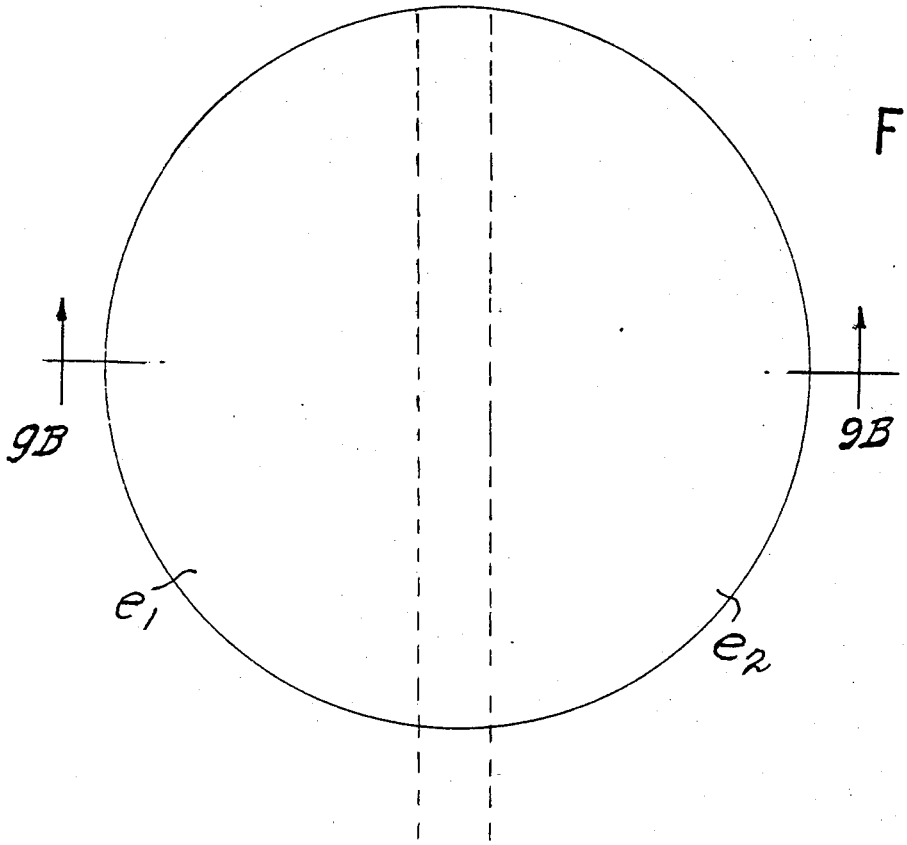
Figure 9B:
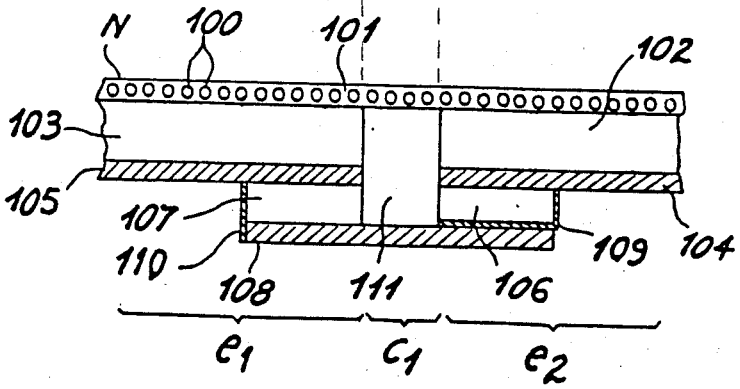

The polarization rotation reflector in accordance with the invention illustrated in FIGS. 9A, 9B, and 9C comprises an integument N sufficiently rigid to allow satisfactory guiding without being brittle in the region of the articulation. This integument N comprises a grid of wires 100 and of different preimpregnates of resin and adhesive 101 and covers the whole surface of the reflector formed, in the case of FIG. 9, by two polarizer-reflector elements, $e_1$ considered as fixed and $e_2$ movable with respect to $e_1$ around the articulation $C_1$.

The gap present between the two elements $e_1$ and $e_2$ is covered by the integument N and is denoted by the symbol 111. The elements $e_2$ and $e_1$, respectively, are formed consecutively starting from the front surface covered by the integument N and towards the rear surface, by a layer 102 and 103 respectively, of expanded or honeycomb structure for example, of which the adhesion to the integument N is facilitated by the composition of the said integument. The element $e_2$, or $e_1$, then comprises a thin layer 104 or 105 acting as a reflector, and a layer 106 or 107, of dielectric. The thin reflective layer 104 or 105 may, for example, be a metal film or a grid of wires or else a composite material based on carbon fibres. The thickness of the layer 106 or 107 of dielectric is calculated so as to compensate for the difference between the dielectric constant of the layer 102 or 103 of foam or honeycomb structure and that of the air.

A metal strip 108 entirely covers the gap 111. It is bonded to the dielectric layer 107 of the fixed element $e_1$ and is in electrical contact with the reflective layer 105 by means of pillars 110. It follows the displacement of the movable element $e_2$ whilst maintaining an electrical contact with the reflective layer 104 by means 109.

This structure makes it possible to obtain an electrical continuity in the region of the front surface since the grid of wires covers the whole surface of the reflector and consequently both elements $e_1$ and $e_2$ without interruption. On the other hand, it assures satisfactory location of the movable element.

The metal strip 108 is movable whilst providing electrical continuity throughout the reflective surface during the displacement of the element $e_2$. It is situated at a distance from the integument N such that the phase shift is 180° in the gap. Thus, the radiation which enters the gap and is not reflected by surfaces 104 and 105 will be reflected by surface 108. Since surface 108 is spaced $\lambda/2$ from the layers 104 and 105, radiation reflected from surface 108 will be in phase with the radiation reflected from layers 104 and 105.

A description has thus been given of an inverted Cassegrain antenna of which the beam may be widened during operation in an elevation or bearing direction and which comprises a polarization rotation reflector providing electrical continuity at the front surface and a phase displacement of 180° throughout the surface of the polarizer. It may particularly be employed in multiple function radars.

We claim:

1. A radar reflector, comprising:

a plurality of polarizer-reflector elements articulatable with respect to each other with a gap between adjacent elements, each element including a support layer having a first face and a second face which is covered by a reflective layer;

flexible sheet means for covering the first face of said support layer and straddling said gap; and hinge means for providing articulation between said elements, said hinge means straddling said gap and including rigid reflecting means for reflecting radiation penetrating said gap, said rigid reflecting means having a first end in electrical contact with the reflective layer of one element and a second end in electrical contact with the reflective layer of an adjacent element.

2. A reflector according to claim 1 wherein said rigid reflecting means is disposed at an approximate distance $\lambda/2$ from the reflective layers of adjacent elements, where $\lambda$ is the wavelength of radiation incident on said reflector.

3. A reflector according to claim 1 wherein said support layer includes a dielectric layer.

4. A reflector according to claim 1 wherein said hinge means further includes a dielectric layer disposed between said rigid reflecting means and the reflective layers of adjacent elements, said first end of said rigid reflecting means being fixed to said one element reflective layer, said second end of said rigid reflecting means being in moveable electrical contact with said adjacent element rigid reflective layer, said reflecting means being spaced at an approximate distance $\lambda/2$ from the reflective layers of adjacent elements, where $\lambda$ is the wavelength of radiation incident on said reflector.

5. A reflector according to claim 1, wherein said reflective layer includes metal film.

6. A reflector according to claim 1 wherein said reflective layer includes a grid of conductive wires.

7. A reflector according to claim 1 wherein said reflective layer includes a composite material having carbon fibers.

8. A radar polarization rotating reflector for rotating and reflecting radiation incident thereon, comprising:

a plurality of polarizer-reflector elements articulatable with respect to each other with a gap between adjacent elements, each element including a first dielectric layer having a first face and a second face which is covered by a metal surface;

flexible sheet means for covering the first face of all of said elements and straddling all of the gaps, said sheet means including a plurality of parallel metal wires which are inclined at approximately 45° with respect to a direction of polarization of said incident radiation; and hinge means for providing articulation between adjacent elements, said hinge means straddling said gap and including:

at least one second dielectric layer arranged parallel to the metal surfaces of adjacent elements; and a rigid metal member mounted on said at least one second dielectric layer and having a first end fixed to the metal surface of one element and a second end in moveable electrical contact with the metal surface of an adjacent element.

9. A reflector according to claim 8 wherein said metal member is disposed at an approximate distance $\lambda/2$ from the metal surfaces of adjacent elements, where $\lambda$ is the wavelength of said incident radiation.

10. A reflector according to claim 8 wherein said metal surface includes metal film.

11. A reflector according to claim 8 wherein said metal surface is disposed at an approximate distance $\lambda/4$ from said flexible sheet means, where $\lambda$ is the wavelength of said incident radiation.

12. A reflector according to claim 8 wherein said metal surface includes a grid of conductive wires.

13. A reflector according to claim 8 wherein said metal surface includes a composite material having carbon fibers.

14. An inverted Cassegrain antenna, comprising:

a curved primary reflector having a focus;

a primary source of electromagnetic waves disposed substantially at said focus; and reflector means for reflecting incident radiation between said primary reflector and said primary source, said reflector means including:

a plurality of polarizer-reflector elements articlatable with respect to each other with a gap between adjacent elements, each element including a first dielectric layer having a first face and a second face which is covered by a metal surface;

flexible sheet means for covering the first face of all of said elements and straddling all of the gaps, said sheet means including a plurality of parallel metal wires which are inclined at approximately 45° with respect to a direction of polarization of said incident radiation; and hinge means for providing articulation between adjacent elements, said hinge means straddling said gap and including at least one second dielectric layer arranged parallel to the metal surfaces of adjacent elements, and a rigid metal member mounted on said at least one second dielectric layer and having a first end fixed to the metal surface of one element and a second end in moveable electrical contact with the metal surface of an adjacent element.

15. An antenna according to claim 14 wherein said metal member is disposed at an approximate distance $\lambda/2$ from the metal surfaces of adjacent elements, where $\lambda$ is the wavelength of said incident radiation.

16. An antenna according to claim 14 wherein said metal surface is disposed at an approximate distance $\lambda/4$ from said flexible sheet means, where $\lambda$ is the wavelength of said incident radiation.

17. An inverted Cassegrain antenna according to claim 14, wherein said first dielectric layer has a dielectric constant, and wherein said second dielectric layer is disposed to compensate for the different between the dielectric constant of said first dielectric layer and the dielectric constant of air, and wherein said metal member is disposed at such a distance from said sheet means that a phase displacement of 180° occurs in said radiation between said metal member and said sheet means, and wherein said metal member provides electrical continuity between the metal surfaces of adjacent elements to form a continuous reflective surface.

18. An inverted Cassegrain antenna according to claim 14, wherein the metal surface of said elements is formed by a metal film.

19. An inverted Cassegrain antenna according to claim 14, wherein the metal surface of said elements is formed by a grid of conductive wires.

20. A inverted Cassegrain antenna according to claim 14, wherein the metal surface of said elements is formed by a composite material based on carbon fibres.

* * * * *